US005915547A

United States Patent [19]

Chen

[11] Patent Number: 5,915,547

[45] Date of Patent: Jun. 29, 1999

[54] NECKTIE POSITIONING BOX STRUCTURE WITH STACKING FEATURE

[76] Inventor: Chun-Hung Chen, No. 2, Lane 79, Guan Kuang St., Panchiao, Taipei Hsien, Taiwan

[21] Appl. No.: 08/932,373

[22] Filed: Sep. 17, 1997

[51] Int. Cl.[6] ..... B65D 85/18; B65D 21/02; B65H 75/40

[52] U.S. Cl. ..... 206/296; 206/292; 206/509; 242/388.1; 242/395

[58] Field of Search ..... 242/388.1, 395, 242/405.1, 405.2; 206/278, 292, 296, 408, 409, 509; 38/73

[56] References Cited

U.S. PATENT DOCUMENTS

| | | | |
|---|---|---|---|
| 1,878,400 | 9/1932 | Irschik | 38/73 |
| 2,352,427 | 6/1944 | Gantt | 206/292 |
| 2,903,196 | 9/1959 | Fowler | 242/395.7 |
| 3,131,805 | 5/1964 | Gardner | 242/388.1 |
| 4,961,544 | 10/1990 | Bidoia | 242/395 |
| 5,181,670 | 1/1993 | Eaton et al. | 206/296 X |
| 5,669,574 | 9/1997 | Colhoun | 242/395 |
| 5,699,904 | 12/1997 | Ikemoto | 206/296 |

FOREIGN PATENT DOCUMENTS

| | | | |
|---|---|---|---|
| 845602 | 8/1952 | Germany | 206/293 |

*Primary Examiner*—Bryon P. Gehman
*Attorney, Agent, or Firm*—Birch, Stewart, Kolasch & Birch, LLP

[57] ABSTRACT

A necktie positioning box structure comprises a main body, a turning ring, a cover ring, a turning shaft and a fixing clamp. The top part of the main body with an elongated slot has a cover and a turning ring. On the bottom of the main body, is a positioning depressed seat is provided which can coordinate putting a number of neckties in position in the necktie positioning box structure. Below the turning ring is a gear transmission unit composed of two or more gears; the turning shaft and the fixing clamp are located below the turning ring. Such a configuration of necktie positioning box structure will quickly wind the neckties for storage purposes.

12 Claims, 7 Drawing Sheets

NECKTIE POSITIONING BOX STRUCTURE WITH STACKING FEATURE

BACKGROUND OF THE INVENTION

The subject invention relates to a type of necktie positioning box structure, particularly to one that will enable rapid winding of the neckties for storage purposes.

DESCRIPTION OF PRIOR ART

In this age, a man would generally own a number of different neckties which would normally be hanging inside a wardrobe. When he goes outdoors, he would bring his necktie(s) in a conventional necktie box, so that the necktie (s) would not wrinkle or deform. A prior art necktie box is illustrated in FIG. 1, which includes a main body 1, a turning ring 2, a turning shaft 3 and a fixing clamp 4.

When a necktie is placed inside the main body I of a prior art necktie box, the turning ring 2 is rotated to drive the turning shaft 3 and the fixing clamp 4 to turn. However, when the turning shaft 3 is winding the necktie, since its diameter is much smaller than the diameter of the turning ring 2, so when the turning ring 2 is rotated, the turning shaft 3 will take up only a small part of the necktie, so the necktie winding process is time and labor wasting.

Therefore, it is obvious that a prior art necktie positioning box, in the sense of actual applications, does have the inconvenience and weakness that need further improvement.

To seek possible improvement in view of said weakness, the subject inventor has devoted intensive study, with technical applications, and has finally presented a reasonably designed subject invention with effective improvement on said weakness.

SUMMARY OF THE INVENTION

The primary purpose of the subject invention is to provide a type of necktie positioning box structure, comprising mainly a main body, a turning ring, a cover ring, a turning shaft and a fixing clamp; wherein, the top part of the main body with an elongated slot has a cover and a turning ring; and on its bottom part is a positioning depressed seat, to coordinate in the positioning of neckties inside the necktie positioning box structure. Furthermore, below the turning ring is a gear transmission unit that is composed of two or more gears; while a turning shaft and fixing clamp are located below the turning ring.

To enable better understanding of the designing approaches and functions adopted in the subject invention to achieve the above purposes and configuration, the following is detailed description with drawings of the preferred embodiment of the subject invention:

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BRIEF DESCRIPTION OF NUMERALS

| Brief Description of Numerals | |
|---|---|
| 1 | main body |
| 2 | turning ring |
| 3 | turning shaft |
| 4 | fixing clamp |
| 11 | cylinder body |
| 12 | positioning dent |
| 15 | elongated slot |
| 16 | positioning depressed seat |
| 23 | turning shaft |
| 24 | fixing clamp |
| 25 | first gear |
| 31 | turning ring |
| 33 | protruding shaft |
| 41 | cover ring |
| 42 | inner gear |
| 44 | second gear |
| 47 | positioning jut |

DETAILED DESCRIPTION OF PREFERRED EMBODIMENT

Figure 1:
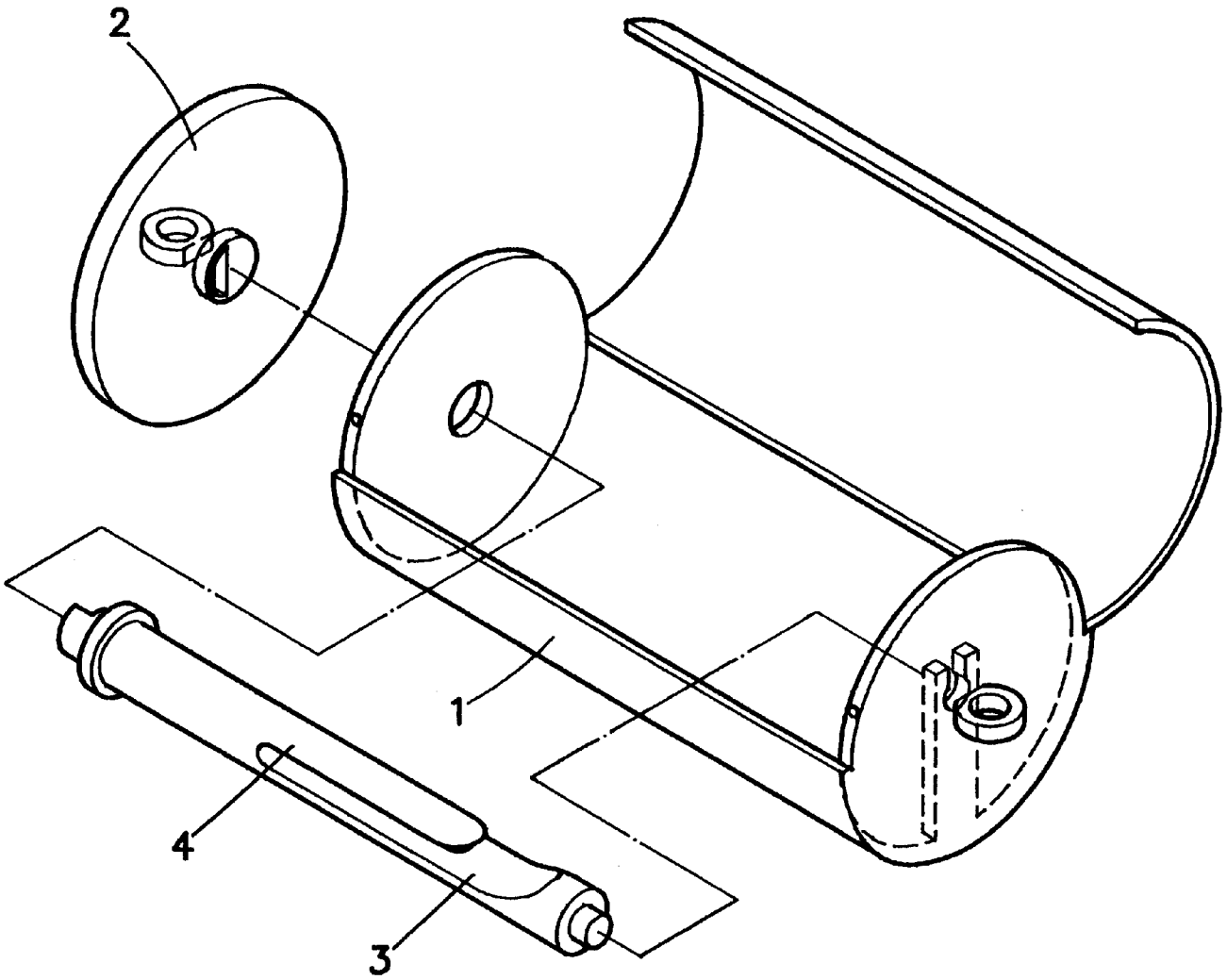
FIG. 1 PRIOR ART
FIG. 1 is a plain view of a prior art.
Figure 2:
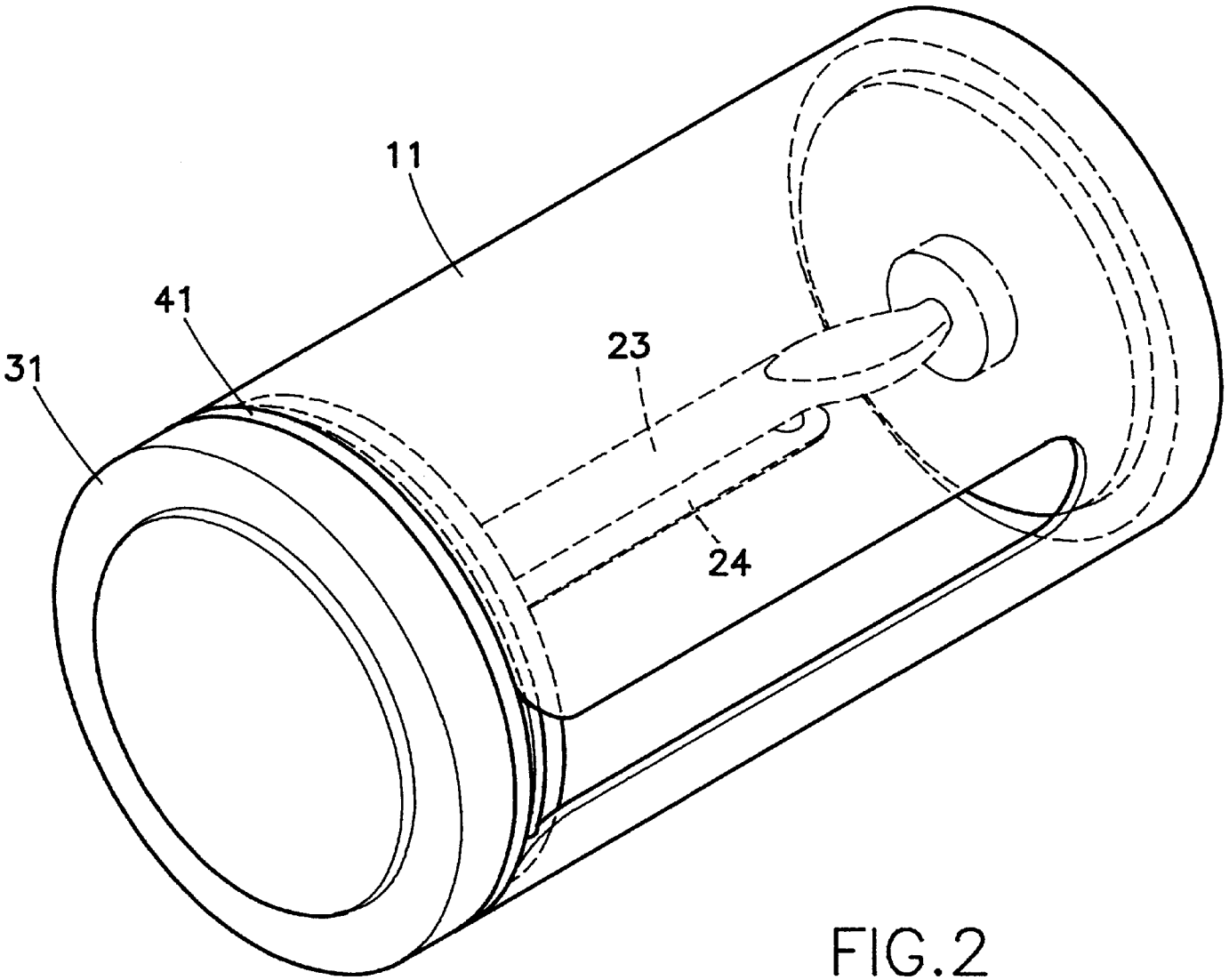
FIG. 2 is a perspective assembled view of the subject invention.
Figure 3:
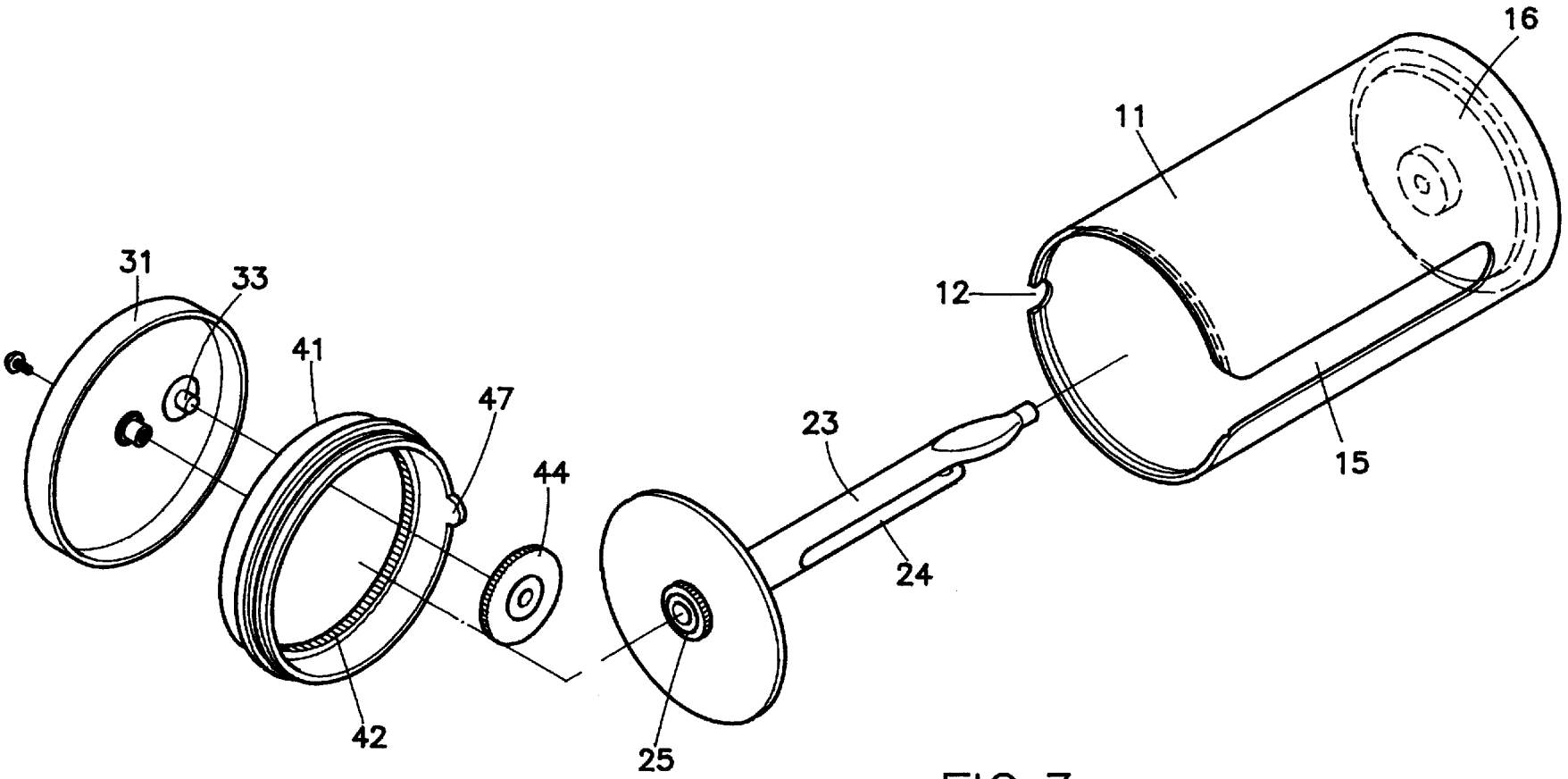
FIG. 3 is an exploded view of the subject invention.
Figure 4:
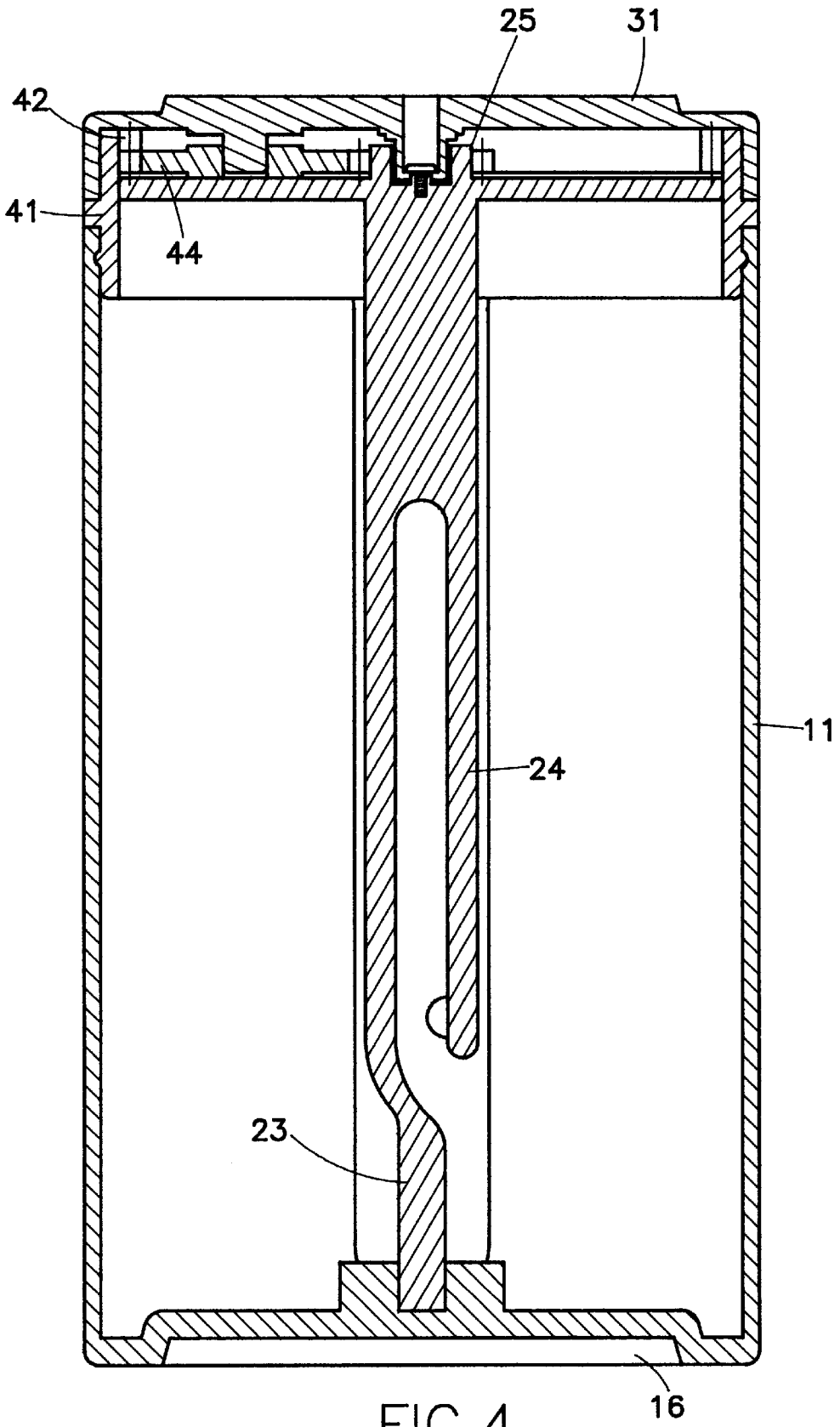
FIG. 4 is a plain view of the subject invention.

Please refer to FIGS. 2, 3 and 4 which are respectively a perspective assembled view, an exploded view and a plain view of the subject invention. The subject invention relates to the presentation of a type of necktie positioning box structure, with features of winding of a necktie for storage purposes.

The subject invention of a necktie positioning box structure comprises mainly a cylinder body 11, a turning ring 31, a cover ring 41, a turning shaft 23 and a fixing clamp 24. The cylinder body 11 comprises an elongated slot 15 and a positioning dent 12, with a turning ring 31 and a cover ring 41 on the top of the cylinder, and a positioning depressed seat 16 on the bottom of the cylinder. Below the turning ring 31 are a turning shaft 23 and a fixing clamp 24.

Figure 5:
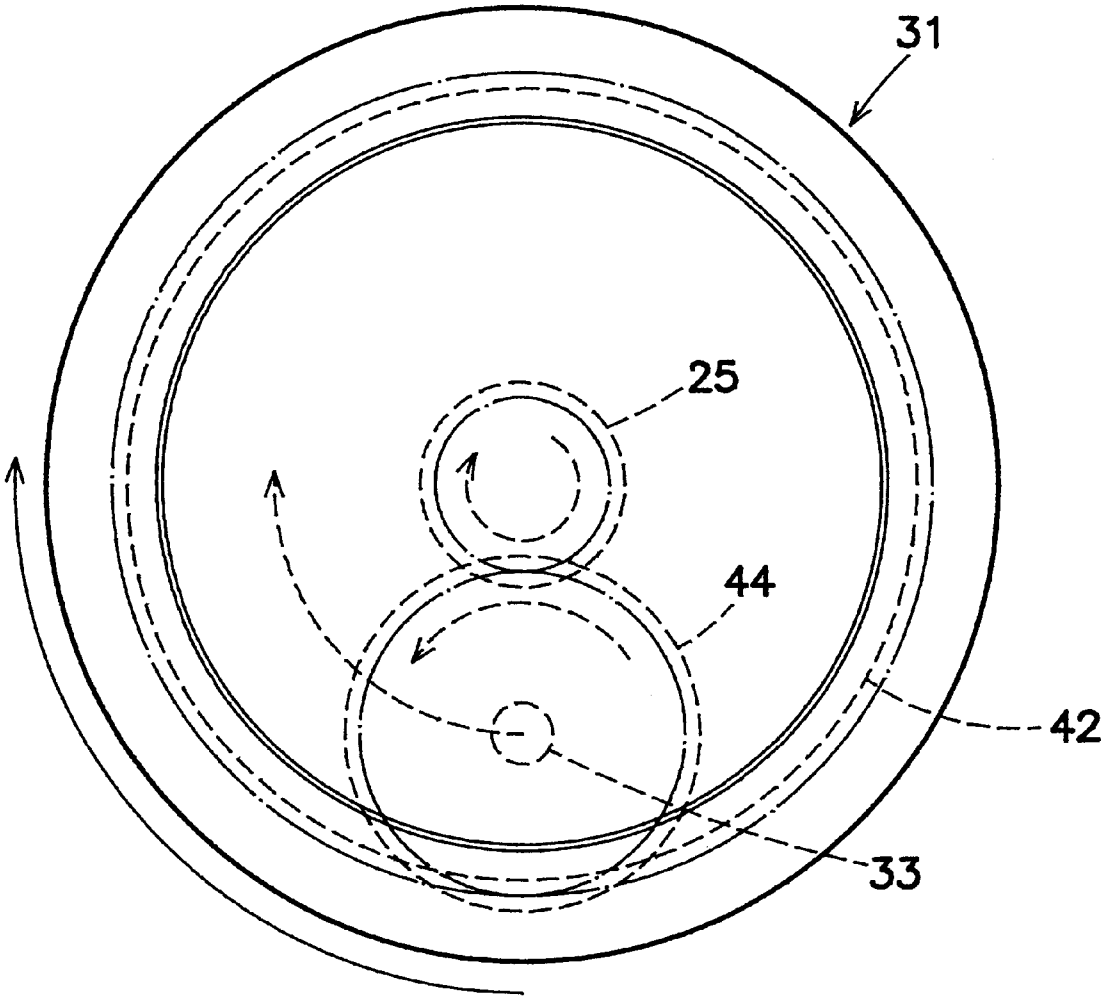
FIG. 5 is an illustration of the gear transmission unit in the subject invention.

Please refer to FIG. 5 which is a gear transmission unit in the subject invention. The turning ring 31 is located at the top of the cover ring 41, inside which is the transmission unit composed of an inner gear 42, a first gear 25 and a second gear 44. When the turning ring is rotated to wind the necktie, the second gear 44 on the protruding shaft 33 below the turning ring 31 will rotate with the inner gear 42 that is connected to the inner edge of the cover ring 41, and the second gear 44 will move along the circumference of the inner gear 42 in a direction opposite to the rotation of the turning ring 31.

At this time, the second gear 44 that is toothed with the inner gear 42 will rotate in a direction opposite to the rotation of the turning ring 31. The first gear 25 that is toothed with the second gear 44 will also rotate in a direction opposite to the rotation of the first gear 21, to drive the turning shaft 23 and the fixing clamp 24 to wind the necktie.

Figure 6:
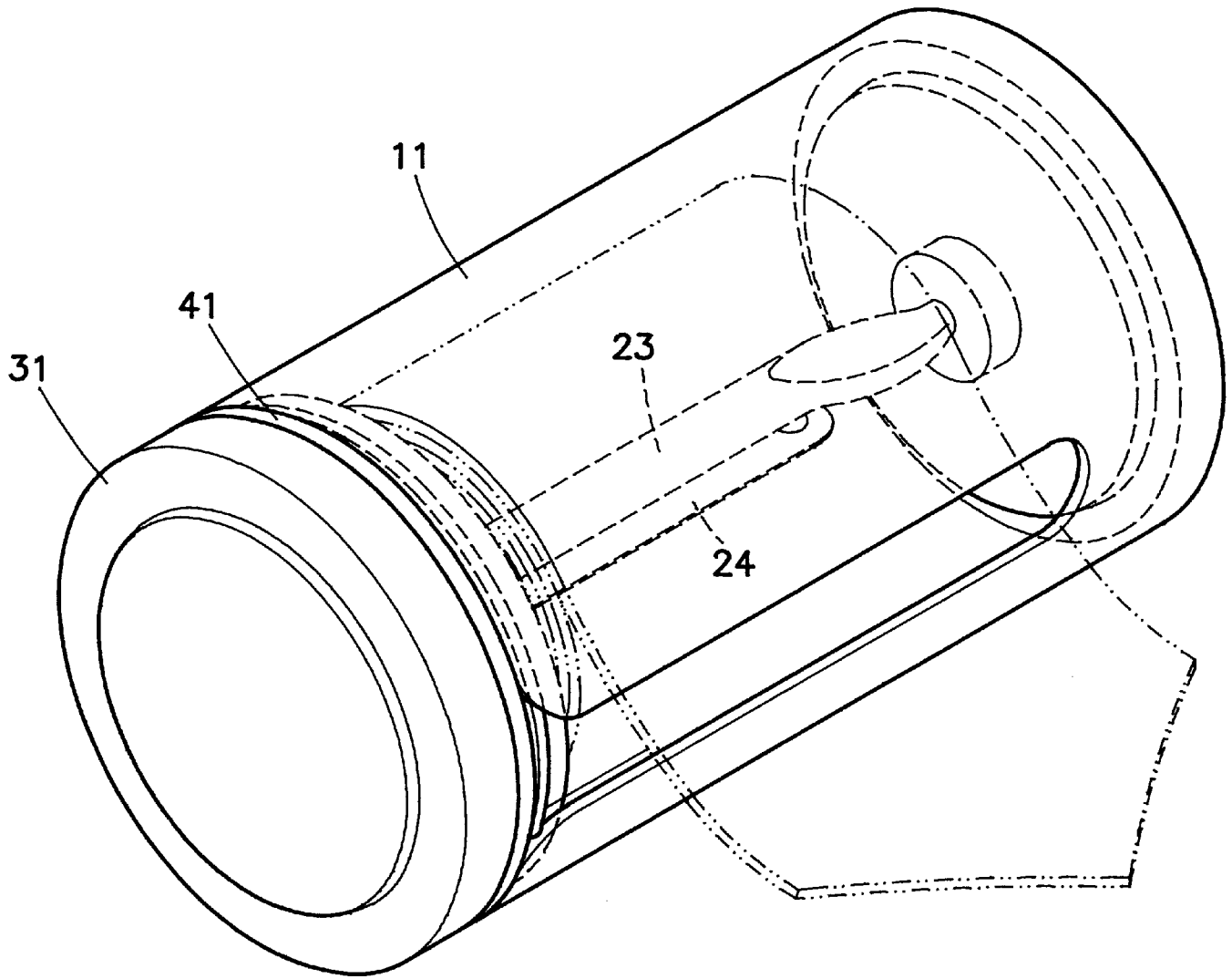
FIG. 6 is an embodiment view of the subject invention.

Please refer to FIG. 6 which is an embodiment view of the subject invention. The positioning jut 47 and the positioning dent 12 (shown in FIG. 3) serve to fasten the subject invention of the necktie positioning box structure. The diameter of the first gear 25 is much smaller than the diameter of the inner gear 42, and the diameter of the first gear 25 is much smaller than the diameter of the second gear 44; therefore, the first gear 25 will be able to rotate quickly to wind the necktie as quick as possible. The subject invention of the necktie positioning box structure will wind the necktie for storage purposes, thus saving much labor, energy and time.

Figure 7:
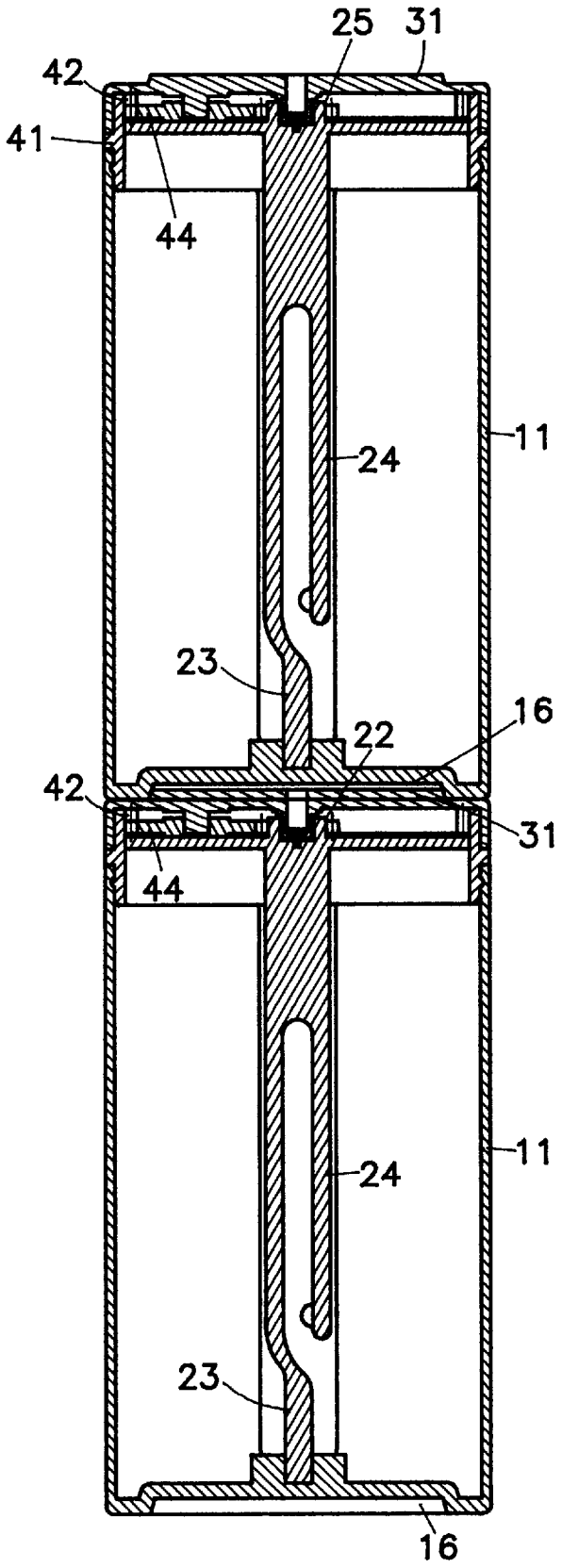
FIG. 7 is another embodiment view of the subject invention.

Please refer to FIG. 7 which is another embodiment view of the subject invention. The subject invention of the necktie positioning box structure involves the configuration that, on the bottom of the cylinder body 11 is a positioning depressed seat 16, while the turning ring 31 may include a positioning jut, with the coordination of the positioning depressed seat 16, to put a number of neckties which are stacked one on the other inside the subject invention of the necktie positioning box structure. The user may easily identify different neckties, and conveniently remove the desired necktie from the elongated slot 15 of the necktie positioning box structure.

Summing up, the subject invention, with effective improvement on the weakness a prior art of necktie positioning box which turning shaft can only wind a small extent of the necktie when the turning ring of the necktie positioning box is rotated, resulting in time- and labor-wasting winding operation, is an unprecedented model with its originality and inventive step that will fully satisfy the requirements for a patent, so, this application is filed in accordance with the Patent Law to protect the subject inventor's rights and interests.

It is hereby declared that the above description, covering only the preferred embodiment of the subject invention, shall not be based to restrict or limit the subject claim, and that all equivalent structural/configurational variations deriving from the subject description with drawings and contents therein shall reasonably be included in the subject claim.

I claim:

1. A necktie positioning box comprising:

a main body having a top and a bottom;

a turning ring rotatably mounted on the top of the main body, the turning ring having a raised outer surface;

a turning shaft having a fixing clamp, the turning shaft being mounted to the turning ring and extending into the main body;

a cover ring mountable below the turning ring and covering the top of the main body;

a positioning depressed seat provided on the bottom of the main body, the raised outer surface of the turning ring being configured to mate with the positioning depressed seat whereby multiple necktie positioning boxes can be stacked together.

2. The necktie positioning box as recited in claim 1, wherein the raised outer surface of the turning ring and the positioning seat both have a circular configuration.

3. The necktie positioning box as recited in claim 2, wherein the main body has a positioning dent and the cover ring has a positioning jut located on an edge thereof, the positioning jut being insertable into the positioning dent when the ring is mounted on the top of the main body.

4. The necktie positioning box as recited in claim 3, wherein the positioning dent is at an upper edge of the main body.

5. The necktie positioning box as recited in claim 4, further comprising an elongated slot in the main body, a necktie being insertable into and removable from the main body through the elongated slot.

6. The necktie positioning box as recited in claim 5, wherein the main body has a cylindrical shape.

7. The necktie positioning box as recited in claim 6, further comprising a gear transmission for connecting the cover ring to the turning shaft.

8. The necktie positioning box as recited in claim 7, wherein the gear transmission comprises at least two intermeshed gears and an inner gear is provided on an interior of the cover ring, one of the at least two gears being engaged with the inner gear on the cover ring.

9. The necktie positioning box as recited in claim 1, further comprising a gear transmission for connecting the cover ring to the turning shaft.

10. The necktie positioning box as recited in claim 9, wherein the gear transmission comprises at least two intermeshed gears and an inner gear is provided on an interior of the cover ring, one of the at least two gears being engaged with the inner gear on the cover ring.

11. The necktie positioning box as recited in claim 10, wherein the main body has a positioning dent and the cover ring has a positioning jut located on an edge thereof, the positioning jut being insertable into the positioning dent when the ring is mounted on the top of the main body.

12. The necktie positioning box as recited in claim 11, wherein the positioning dent is at an upper edge of the main body.

* * * * *